United States Patent [19]

Pollak, Jr. et al.

[11] 4,286,144

[45] Aug. 25, 1981

[54] ENCODER FOR POSTAGE METER

[75] Inventors: Philip Pollak, Jr., Westport; Keith E. Schubert, Rowayton; John L. Lorenzo, Southbury, all of Conn.

[73] Assignee: Pitney Bowes Inc., Stamford, Conn.

[21] Appl. No.: 108,061

[22] Filed: Dec. 28, 1979

[51] Int. Cl.[3] ..... G07G 1/00

[52] U.S. Cl. ..... 235/101

[58] Field of Search ..... 235/1 C, 1 R, 21, 58 P, 235/60 P, 101, 61 PK, 58 R, 58 M

[56] References Cited

U.S. PATENT DOCUMENTS

| | | | |
|---|---|---|---|
| 3,057,547 | 10/1962 | Adler et al. | 235/101 |
| 3,428,948 | 2/1969 | Simjian | 235/101 |
| 4,119,161 | 10/1978 | Price et al. | 235/101 |

*Primary Examiner*—L. T. Hix
*Assistant Examiner*—Benjamin R. Fuller
*Attorney, Agent, or Firm*—Donald P. Walker; William D. Soltow, Jr.; Albert W. Scribner

[57] ABSTRACT

An encoder is provided for a postage meter having a lever which is movable between a plurality of postage value selecting positions. The encoder includes framework adapted for removably mounting the encoder in operating relationship with respect to the postage meter, and includes instrumentalities for monitoring movement of the postage meter lever when the encoder is operationally mounted. Preferably, the monitoring means includes means for providing an electrical signal which varies in response to movement of the postage meter lever from one of its positions to another.

9 Claims, 4 Drawing Figures

ENCODER FOR POSTAGE METER

BACKGROUND OF THE INVENTION

In recent years the historically minor expenses attributable to utilization of the mails have significantly increased as a result of both direct and indirect mailing costs. As these expenses continue to spiral upwardly, the mailing habits of major industries are coming under closer scrutiny with a view to controlling such expenses. In this connection, many major manufacturers of postage meters and systems, including the assignee of the present invention, have recently introduced lines of meter-scale systems, which basically include a highly sensitive scale coupled to a postage meter which automatically prints the proper postage for franking the mailpieces weighed on the scale. Such meter-scale systems have been well received in the marketplace due to their eliminating the direct mailing costs attributable to human errors of the type which would otherwise result in overfranking letters and parcels. Other successful means have been devised for reducing indirect mailing costs. For example, the assignee of the present invention recently introduced a system for remotely resetting postage meters to eliminate the labor costs which would otherwise be incurred for hand-carrying postage meters to the local Post Office for resetting purposes.

With the above thoughts in mind, it should be appreciated that there is a need in the marketplace to provide suitable means for making a record of direct mailing costs on a current basis for cost analysis and other mail control purposes. Accordingly:

- an object of the present invention is to provide a new article of manufacture suitable for use in interfacing a postage meter with, for example, electronic accounting apparatus adapted for recording successive postage meter transactions;
- a further object is to provide apparatus for interfacing a postage meter, of the type which includes a plurality of postage value selecting levers, with electronic accounting means;
- another object is to provide such apparatus with means for encoding the position of the postage value selecting levers of a postage meter; and
- yet another object is to provide an encoder which includes means for monitoring movement of the postage value selecting levers of a postage meter, including means for providing a signal which varies in response to movement of the postage meter levers from one position to another.

SUMMARY OF THE INVENTION

An encoder is provided for a postage meter having a lever which is movable between a plurality of postage value selecting positions. The encoder includes framework adapted for removably mounting the encoder in operating relationship with respect to the postage meter, and includes means for monitoring movement of the postage meter lever when the encoder is mounted in the operating relationship. Preferably, the monitoring means includes means for providing an electrical signal which varies in response to movement of the postage meter lever from one of the positions to another of the positions.

BRIEF DESCRIPTION OF THE DRAWINGS

As shown in the drawing wherein like reference numerals designate like or corresponding parts throughout the several figures.

DESCRIPTION OF THE PREFERRED EMBODIMENT

Figure 1:
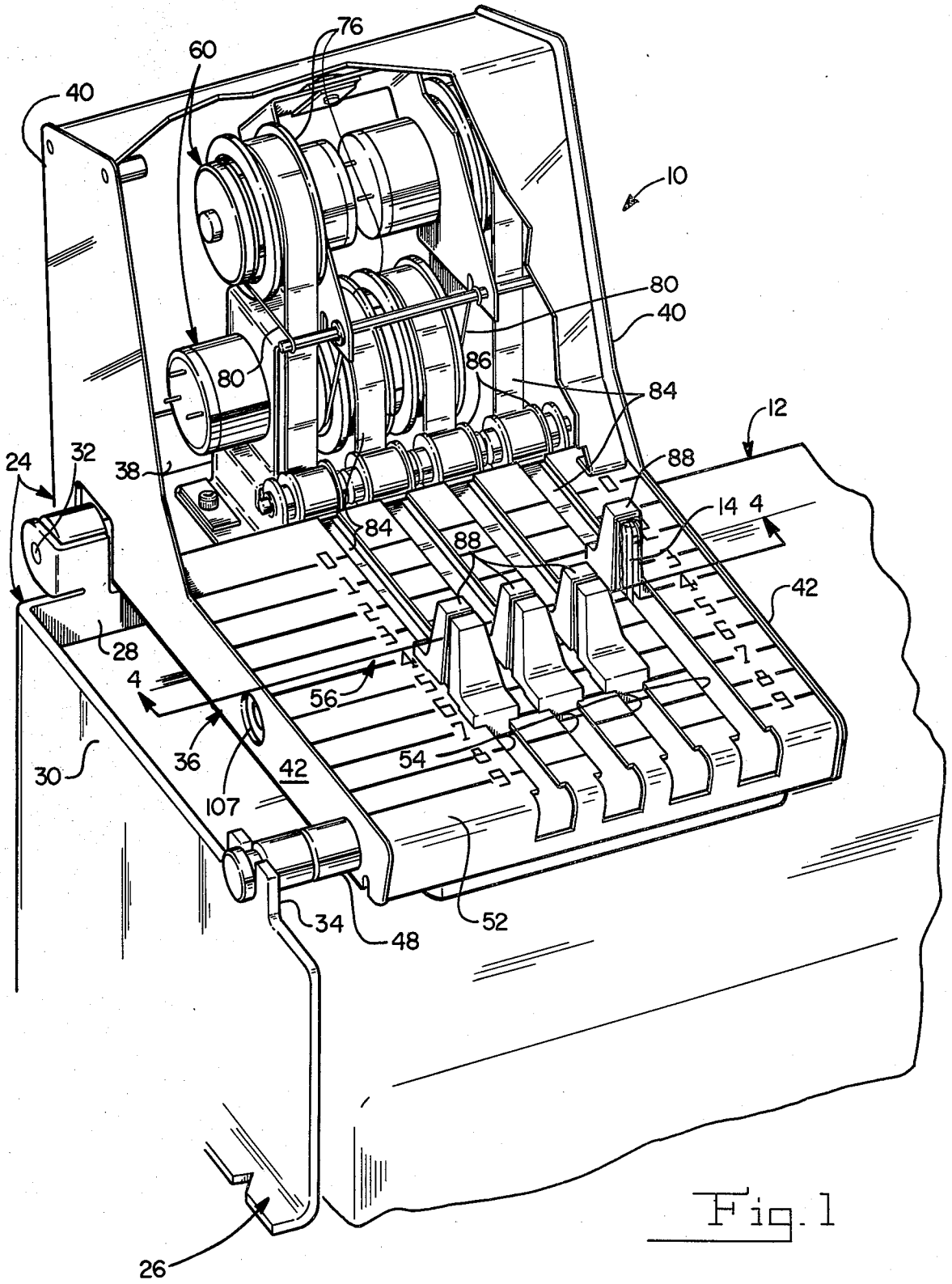
FIG. 1 is a fragmentary perspective view of an encoder according to the invention shown mounted in operating relationship with respect to a postage meter.

As shown in FIG. 1, an encoder 10 in accordance with the present invention is mounted in its operating relationship with respect to a postage meter 12, such as a Series 5300 or 2200 Postage Meter commercially available from the assignee of the present invention or any other postage meter of the type which generally includes well-known means for printing postage (not shown) and a plurality of postage value selecting levers 14 (FIG. 2) which are suitably operationally coupled to the printing means. The postage meter levers 14 are ordinarily manually positionable in a plurality of positions 16, corresponding to the values of zero through nine, identified by the numerals 18 partially shown on the postage meter 12 (FIG. 2), for selecting desired postage values to be printed. In accordance with the invention, each of the levers 14 includes a pin 20 extending in a direction transverse to the direction of movement of the levers 14 to facilitate movement of the levers 14 by means the encoder 10.

Figure 2:
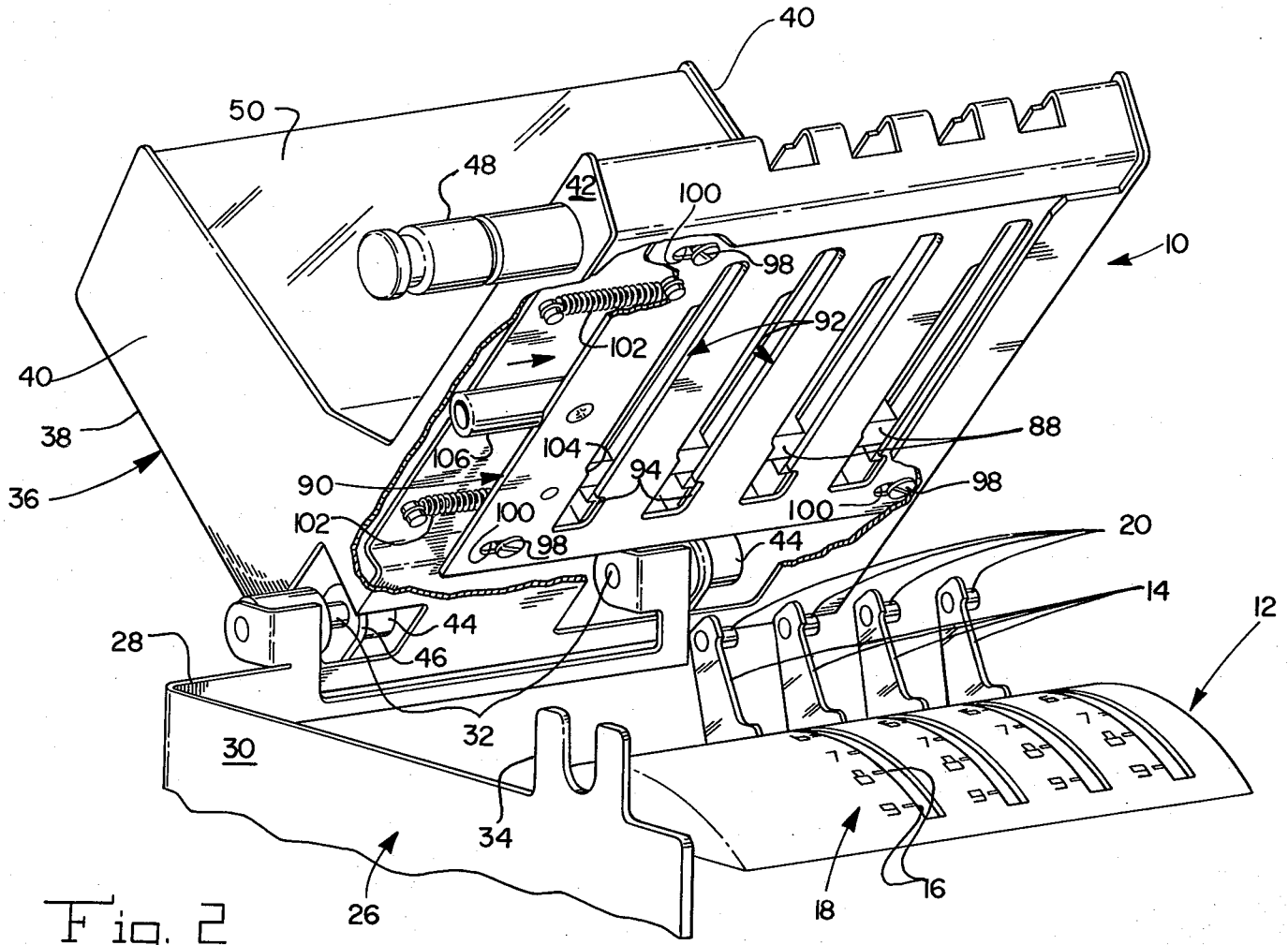
FIG. 2 a fragmentary view of the encoder of FIG. 1 mounted on a postage meter, and shows the manner in which the operating components of the encoder may be raised for directly accessing the postage meter levers.

The encoder 10 (FIG. 1) includes framework 24 for removably mounting the encoder 10 in operating relationship with respect to the postage meter 12 and for supporting the operating components of the encoder 10. The framework 24 includes a lower support 26 which acts as a pedestal for the encoder 10. The lower support 26 may be attached to any conveniently located structure which does not inhibit removal of the postage meter 12 independently of the encoder 10, or may be conventionally removably fastened to the postage meter 12. As shown in FIG. 2, the lower support 26 includes a rear wall 28, and includes at least one side wall 30 which extends forwardly from the rear wall 28. In addition, the lower support 26 includes a pair of appropriately spaced hinge pins 32 which are integrally connected to the rear wall 28, and includes an upwardly-extending crutch member 34 which is integrally connected to the forward end of the side wall 30. The framework 24 also includes an upper support 36 which acts as a platform for the various operating components of the encoder 10. The upper support 36 includes a rear wall 38 (FIG. 1) and a pair of parallel-spaced side walls 40, the latter extending forwardly from the rear wall 38. Each of the side walls 40 is an upright, L-shaped member, which includes a lower, forwardly-extending leg 42. The upper support 36 (FIG. 2) also includes a pair of hubs 44, which are spaced apart from each other and fixedly attached to the rear wall 38 by means of a bracket 46. The hubs 44 extend from the rear wall 38 toward the lower support hinge pins 32 and are correspondingly appropriately spaced for axially receiving the pins 32 for pivotally mounting the upper support 36 on the pins 32, and thus on the lower support 26, while at the same time affording for ease of removal of the upper support 36 from the lower support 26. In addition, the upper support 36 includes a support lifting pin 48. The pin 48 transversely extends from one of the side wall legs 42 and is adapted for seating engagement with the crutch member 34 for providing horizontal stability for the upper support 36 relative to the lower support 26. Preferably, the pin 48 is adapted to be manually grasped for pivotally raising the upper support 36 off the lower support 26 to gain access to the postage meter levers 14. Further, the upper support 36 includes a top wall 50 which extends between the side walls 40. The top wall 50 includes a lower, forwardly-extending lever position indicating plate 52 (FIG. 1) which is associated with the forwardly-extending legs 42 of the side walls 40. The plate 52 includes a plurality of parallel-spaced forwardly-extending apertures 54. The apertures 54 are appropriately located and dimensioned to receive the postage meter levers 14 on a one-for-one basis, when the encoder 10 is operatively mounted relative to the postage meter 12, and to accommodate movement of the levers 14 within the apertures 54. Inasmuch as the plate 52 overhangs and obscures the postage meter lever position numerals 18 (FIG. 2) from view, when the encoder 10 is operatively mounted relative to the postage meter 12, the plate 52 (FIG. 1) is provided with lever position indicating numerals 56 corresponding to the postage meter lever position numerals 18 (FIG. 2) for identifying the ten positions 16, zero through nine, to which each of the postage meter levers 14 may be moved for selecting postage values; of for example from zero through ninety-nine dollars and ninety-nine cents in the case of a four-lever postage meter 12.

Figure 3:
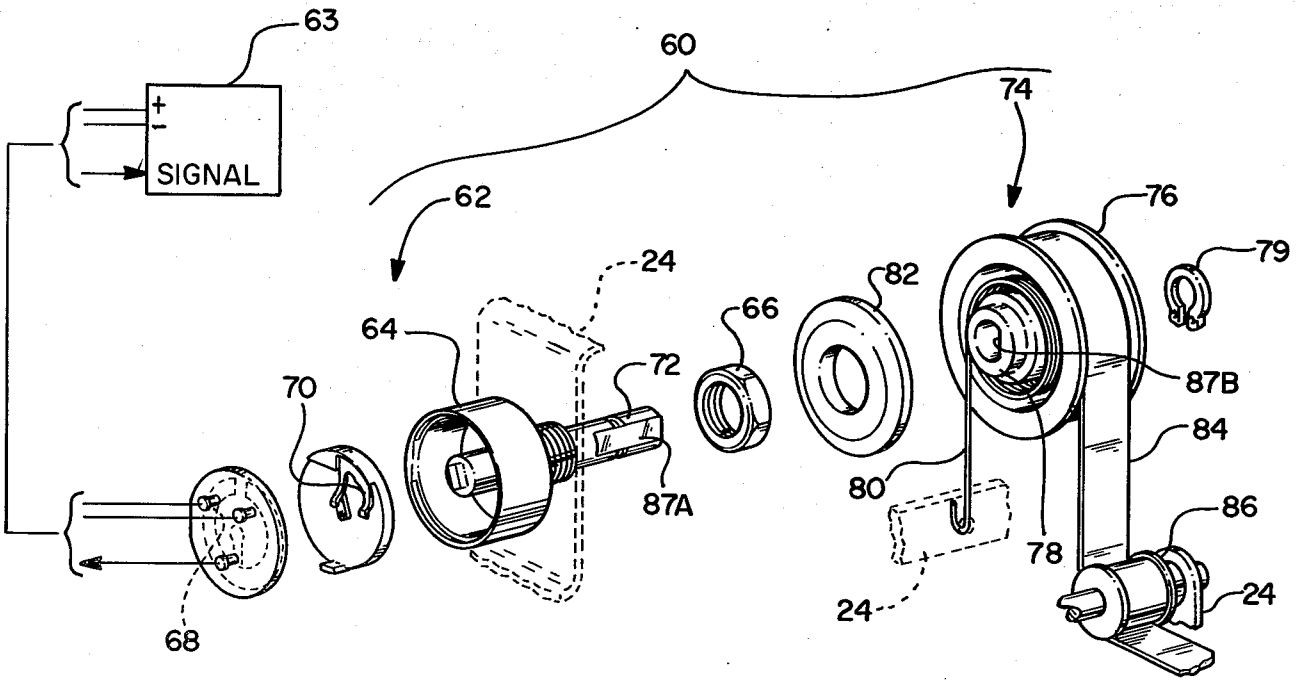
FIG. 3 is a fragmentary exploded perspective view of the postage meter lever monitoring means of the encoder of FIG. 1.

For monitoring movement of the postage meter levers 14 (FIG. 1) when the encoder 10 is mounted in operating relationship with respect to the postage meter 12, the encoder 10 includes a plurality of transducer assemblies 60. Each of the transducer assemblies 60 (FIG. 3) includes a conventional, variable, linear potentiometer 62, which is adapted to be energized from a conventional source of supply of power, as for example found in remotely located electronic accounting apparatus 63 which is interfaced with the postage meter 12 by means of the encoder 10. The potentiometer 62 includes a housing 64 which is suitably fixedly attached to the framework 24, as by means of a fastener 66. In addition, the potentiometer 62 has a stationary linear resistance 68; and includes a wiper 70 which is mounted on a rotatable shaft 72 that extends from the housing 64. Each of the transducer assemblies 60 also includes an arrangement of apparatus 74 for actuating the potentiometer 62, including a pulley 76 having a hub 78 which is conventionally press-fit to the potentiometer shaft 72. As a precautionary measure, a grip ring 79 may be provided as security against the possibility of the press-fitting tolerances not being met by manufacturing personnel. The actuating apparatus 74 also includes a coil spring 80, which is looped about the pulley's hub 78, and has one end fixedly attached to the hub 78 and the other end suitably removably anchored to the framework 24. To confine the spring 80 in place, the actuating apparatus 74 includes a washer 82 which is dimensioned to cover the cavity in which the spring 80 is mounted, and is suitably fixedly attached to the pulley 76 as by welding. Further, the actuating apparatus 74 includes a flexible metal band 84 for rotating the pulley 76 against the tension of the spring 80. The band 84 has one end fixedly attached to the pulley 76 and is looped thereabout and about one of a plurality of idler pulleys 86. Each of the idler pulleys 86 is suitably rotatably attached to the framework 24 for guiding one of the bands 84 beneath the encoder's lever position indicating plate 52 (FIG. 1) and lengthwise of one of the plate apertures 54 for connecting the band 84 to the postage meter lever 14 protruding through the associated aperture 54. For positionally synchronizing the potentiometer wiper 70 (FIG. 3) and associated lever 14 (FIG. 1), the potentiometer shaft 72 (FIG. 3) and pulley hub 78 are respectively provided with appropriately located, complementary flats, 87A and 87B. Preferably, the actuating apparatus 74 includes a plurality of caps 88 (FIG. 1) each of which is slideably mounted in one of the plate apertures 54, is adapted to be removably mounted on the associated postage meter lever 14, is adapted to be manually moved for moving the associated lever 14 and is fixedly attached to one of the bands 84 for movement therewith. Accordingly, assuming the encoder 10 is mounted in operating relationship with respect to the postage meter 12 (FIG. 1); the caps 88 are mounted in engagement with the postage meter levers 14, and, movement of the caps 88 results in movement of the associated levers 14. With this arrangement, movement of a given cap 88, and thus the associated lever 14, toward the "nine" position results in the cap 88 pulling the associated band 84 forwardly towards the "nine" position, thereby rotating the associated pulley 76 against the tension of its spring 80; whereas movement of the cap 88 toward the "zero" position permits the associated spring 80 to rotate the associated pulley 76, thereby pulling the associated band 84 rearwardly towards the "zero" position. In either instance, the potentiometer wiper 70 (FIG. 3) is moved relative to the ends of the linear resistance 68 for providing a signal which varies in response to movement of the associated postage meter lever 14 (FIG. 1). Assuming energization of the potentiometer 62 (FIG. 3), the signal from the potentiometer 62 is an analog representation of the particular position, at any given time, of the associated postage meter lever 14 (FIG. 1) within the lever's ten-position range of positions 16.

As shown in FIG. 2, the encoder 10 includes a generally rectangularly-shaped base 90 having a plurality of parallel-spaced apertures 92. The apertures 92 are appropriately located and dimensioned to receive the postage meter levers 14 on a one-for-one basis, when the encoder 10 is operatively mounted relative to the postage meter 12, and to accommodate movement of the levers 14 within the apertures 92. For synchronizing the encoder 10, and thus the postage meter 12, with for example conventional memory circuitry incorporated in the electronic accounting apparatus 63 (FIG. 3) the base apertures 92 (FIG. 2) each include a portion 94 thereof which is located and dimensioned to permit passage of the appropriate postage meter lever 14 through the aperture 94 for engagement with the appropriate cap 88, provided the lever 14 is located in a particular one of the postage value selecting positions 16; which position is ordinarily referred to as the synchronization position and is preferably the zero value position for each lever 14. With this arrangement, the postage meter levers 14 must ordinarily be moved to their synchronization positions for lowering the encoder's upper support 36, since the base 90 would otherwise block passage of the postage meter lever pins 20, and thus the levers 14, through the apertures 92. Conversely, and for the same reason, the levers 14 have to be returned to their synchronization positions for raising the upper support 36. On the other hand, it should be noted that whenever the upper support 36 is raised above the lower support 26, the pulley springs 80 (FIG. 3) rotate the associated pulleys 76 to pull the caps 88 (FIG. 2) to their zero positions, as a result of which the operator need not move the caps 88 to their synchronization position and is reminded to move the levers 14 to their corresponding synchronization position before lowering the upper support 36.

Figure 4:
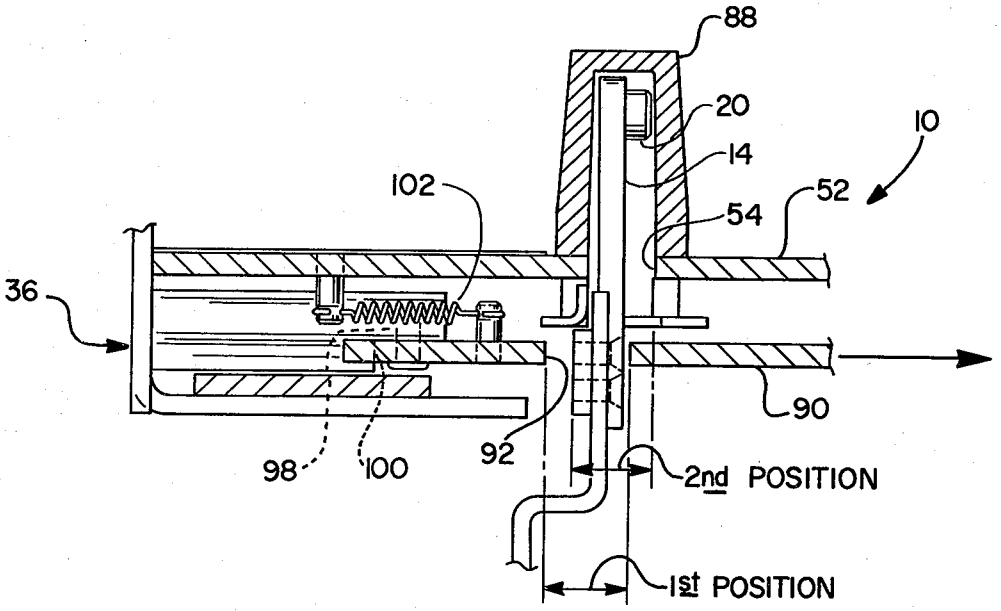
FIG. 4 is an enlarged fragmentary view of the encoder, taken substantially along the line 4—4 of FIG. 1, showing the normal alignment of the postage meter levers with respect to the apertures formed in the top and base walls of the encoder.

To facilitate raising the upper support 36 (FIG. 2) without returning the levers 14 to their synchronization position, for example, to permit accessing the postage meter levers 14 to clear a jam condition of one or more of the levers 14, the encoder 10 preferably includes a manually movable, two-position base 90, having one position in which the base 90 blocks the passage of the postage meter levers 14 through the base 90 as hereinbefore described, and having another position to which the base 90 may be moved and wherein the base 90 does not block such passage. To that end, the encoder 10 includes conventional means for slideably attaching the base 90 to the framework 24, such as a plurality of appropriately located fasteners 98 and a like number of slots 100 which are formed in base 90 for receiving the fasteners 98. In addition, the encoder 10 includes at least one and preferably a plurality of tension springs 102, each of which has one end suitably attached to the framework 24 and the other end suitably attached to the base 90, for urging the base 90 into the position shown in FIG. 2, wherein the base 90 blocks passage of the levers 14 through the base 90 unless the levers 14 are located in their synchronization positions. In addition, each of the base apertures 92 includes an enlarged second portion 104 which extends lengthwise of the aperture 92. And, the base 90 preferably includes a shaft 106, which extends towards one of the sidewall legs 42 and in sufficiently close proximity to an aperture 107 (FIG. 1) formed in that sidewall leg 42 to permit manually accessing the shaft 106 (FIG. 2), as by means of a pencil (not shown), for moving the shaft 106 and thus the base 90 against the tension of the springs 102. The base 90 may thereby be moved to a second position (FIG. 4) wherein the base apertures 92 are aligned with the levers 14 so as to permit passage of the levers 14 through the base apertures 92, although the levers 14 are not disposed in their respective synchronization positions. In practice, the respective aperture portions, 94 and 104 (FIG. 2), are dimensioned to permit the passage of the postage meter levers 14 through the base 90 when any or all of the levers 14 are located in a position other than their synchronization positions and the base 90 is moved to its second position. Accordingly, if the base 90 is located in either of its first or second positions the upper support 36 may be raised if all of the levers 14 are located in their respective synchronization position. With this arrangement, if the base 90 jams in its second position, operation of the encoder 10 and postage meter 12 is not impaired.

To prevent the operator of the encoder 10 (FIG. 4) from inadvertently jamming one or more of the postage meter levers 14 between the encoder's plate 52 and base 90, the caps 88 are constructed and arranged to sufficiently closely surround the associated postage meter levers 14 and extend sufficiently below the encoder's plate 52, to restrict both horizontal and vertical movement of the encoder's upper support 36 within limits designed to prevent the operator from raising the upper support 36 sufficiently to disengage any of the caps 88 from their associated levers 14 unless either the base 90 is moved to its second position or the levers 14 are all returned to their synchronization positions.

In accordance with the objects of the invention there has been described apparatus for interfacing a postage meter, of the type which includes a plurality of postage value selecting levers, with electronic accounting means; and more particularly an encoder for such a postage meter, wherein the encoder includes means for monitoring movement of the postage meter levers so as to provide a signal which varies in response to movement of the postage meter levers from one position to another position.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. An encoder for a postage meter having a lever which is movable between a plurality of postage value selecting positions, said encoder comprising:

(a) framework adapted for removably mounting said encoder in operating relationship with respect to said postage meter; and (b) means for monitoring movement of said postage meter lever when said encoder is mounted in said operating relationship, said monitoring means including means for providing an electrical signal which varies in response to movement of said postage meter lever from one of said positions to another of said positions.

2. The encoder according to claim 1, wherein said monitoring means includes a linear potentiometer adapted to be electrically energized for providing said signal, said monitoring means including means for actuating said potentiometer, and said actuating means coupled to said postage meter lever for movement therewith when said encoder is mounted in said operating relationship.

3. The encoder according to claim 1, wherein said framework includes a wall having an aperture formed therein which is dimensioned to permit movement of said postage meter lever within said wall aperture when said encoder is mounted in said operating relationship with respect to said postage meter.

4. The encoder according to claim 1, including a base connected to said framework, said base having an aperture formed therein, and said base aperture including a first portion thereof dimensioned to permit movement of said postage meter lever within said aperture when said encoder is mounted in said operating relationship with respect to said postage meter.

5. The encoder according to claim 2, wherein said potentiometer includes a linear resistance and a wiper, said actuating means including spring means adapted to urge said wiper into a home position, and said actuating means including an elongated strip of flexible material removably coupleable to said postage meter lever for movement therewith against the urging of said spring means when said encoder is mounted in said operating relationship with respect to said postage meter.

6. The encoder according to claim 4, wherein said framework includes a wall, said wall including means for identifying the respective positions to which said postage meter lever is movable for postage value selecting purposes when said encoder is mounted in said operating relationship with respect to said postage meter, and said base aperture including a second portion thereof dimensioned to permit passage of the postage meter lever through said base aperture when said postage meter lever is disposed in a unique one of said postage value selecting positions.

7. The encoder according to claim 4, wherein said base is movably connected to said framework for movement between a first position and a second position, said encoder including spring means interconnecting said base and framework for urging said base into said first position, said base blocking passage of said postage meter lever therethrough when said base is disposed in said first position, said base adapted to be manually moved from said first position to said second position and said base aperture including a second portion thereof dimensioned for permitting passage of said lever through said base when said base is disposed in said second position.

8. The encoder according to claim 5, wherein said actuating means includes a cap removably mountable on said postage meter lever for movement thereof when said encoder is mounted in operating relationship with respect to said postage meter, said strip of material being fixedly attached to said cap, and said cap adapted to be manually moved for moving said postage meter lever.

9. The encoder according to claim 7, wherein said framework has an aperture formed therein, and said base including a shaft fixedly extending towards said framework and in sufficiently close proximity thereto to permit said shaft to be manually accessed via said framework aperture for movement of said base.

* * * * *